US009927192B1

(12) United States Patent
Sylvester

(10) Patent No.: US 9,927,192 B1
(45) Date of Patent: Mar. 27, 2018

(54) BUFFER TUBE LOCKING PLATE

(71) Applicant: Primary Weapons, Boise, ID (US)

(72) Inventor: Dean Sylvester, Boise, ID (US)

(73) Assignee: Primary Weapons, Boise, ID (US)

( * ) Notice: Subject to any disclaimer, the term of this patent is extended or adjusted under 35 U.S.C. 154(b) by 0 days.

(21) Appl. No.: 15/410,530

(22) Filed: Jan. 19, 2017

Related U.S. Application Data

(60) Provisional application No. 62/280,497, filed on Jan. 19, 2016.

(51) Int. Cl.
*F41A 3/78* (2006.01)
*F41C 23/00* (2006.01)

(52) U.S. Cl.
CPC ..... *F41A 3/78* (2013.01); *F41C 23/00* (2013.01)

(58) Field of Classification Search
CPC ..... F41A 3/78; F41A 3/80; F41A 3/82; F41A 3/90; F41A 3/92; F41A 3/94; F41C 23/00; F41C 23/04; F41C 23/06; F41C 23/14; F41C 23/20
USPC ..... 42/75.03, 75.01, 71.01
See application file for complete search history.

(56) References Cited

U.S. PATENT DOCUMENTS 1,628,798 A * 5/1927 Nelson ..... F41A 21/482 42/75.02
3,405,470 A 10/1968 Wesemann
3,417,660 A 12/1968 Harbrecht
3,461,589 A 8/1969 Vironda
4,644,987 A 2/1987 Kiang
5,909,002 A 6/1999 Atchisson
6,758,126 B1 7/2004 Houtsma
7,131,367 B1 11/2006 Boerschig et al.
7,213,498 B1 5/2007 Davies
7,398,616 B1 7/2008 Weir
7,681,351 B2 3/2010 Bucholtz et al.
7,770,317 B1 * 8/2010 Tankersley ..... F41C 23/16 42/71.01
7,793,453 B1 9/2010 Sewell et al.
7,823,313 B2 11/2010 Faifer
8,037,806 B2 10/2011 Davies
8,459,406 B1 6/2013 Dueck
8,468,729 B1 * 6/2013 Sylvester ..... F41A 3/84 42/1.01
D717,906 S 11/2014 Montes
8,991,088 B1 * 3/2015 Young ..... F41A 25/00 42/75.03
D738,985 S 9/2015 Montes
D780,875 S 3/2017 Sylvester
2004/0031182 A1 2/2004 Bentley
2005/0115134 A1 6/2005 Bond et al.
2008/0110074 A1 * 5/2008 Bucholtz ..... F41C 23/06 42/1.06
2010/0050492 A1 3/2010 Faifer
(Continued)

OTHER PUBLICATIONS nokick.com—Youtube, PWS EBT—Enhanced Buffer Tube, https://www.youtube.com/watch?v=of062guwt7o, Feb. 12, 2015, [site visited Jul. 18, 2016], 2 pages.

(Continued)

*Primary Examiner* — Derrick R Morgan
(74) *Attorney, Agent, or Firm* — Schacht Law Office, Inc.; Dwayne Rogge

(57) ABSTRACT

Disclosed herein is a buffer tube locking plate assembly facilitating secure attachment of a buffer tube to a receiver portion of a firearm.

5 Claims, 2 Drawing Sheets

(56) References Cited

U.S. PATENT DOCUMENTS

| | | | | |
|---|---|---|---|---|
| 2010/0251587 | A1 | 10/2010 | Kincel | |
| 2010/0251588 | A1 | 10/2010 | Kincel | |
| 2011/0271827 | A1* | 11/2011 | Larson | F41A 5/28 89/193 |
| 2012/0132068 | A1* | 5/2012 | Kucynko | F41C 23/16 89/191.01 |
| 2012/0180353 | A1* | 7/2012 | Holmberg | F41A 3/84 42/1.06 |
| 2013/0180150 | A1 | 7/2013 | Dueck | |
| 2015/0000171 | A1* | 1/2015 | Roberts | F41A 3/66 42/75.03 |
| 2015/0345895 | A1* | 12/2015 | Young | F41A 11/04 42/71.01 |
| 2016/0054094 | A1* | 2/2016 | Colt | F41C 23/04 42/75.03 |
| 2016/0202016 | A1* | 7/2016 | Mather | F41C 23/14 42/73 |
| 2017/0205187 | A1* | 7/2017 | Brown | F41C 23/04 |
| 2017/0227312 | A1* | 8/2017 | Christensen | F41A 9/65 |
| 2017/0299321 | A1* | 10/2017 | Lort | F41B 11/62 |

OTHER PUBLICATIONS

Primary Arms, PWS Enhanced buffer tube-Mod 2-Mil-Spec, http://www.primaryarms.com/4g2btmb1/p/4g2btmb1, publication date unknown, [site visited Jul. 18, 2016], 1 page.

Primary Weapons System, PWS EBT MOD 2, https://primaryweapons.com/store/product/pws-ebt-mod-2/, publication date unknown, [site visited Jul. 18, 2016], 5 page.

* cited by examiner

BUFFER TUBE LOCKING PLATE

RELATED APPLICATIONS

This application claims priority benefit of U.S. Ser. No. 62/280,497, filed Jan. 19, 2016, incorporated herein by reference.

BACKGROUND OF THE DISCLOSURE

Field of the Disclosure

This disclosure relates to the field of locking components which facilitate locking threaded attachment of a buffer tube to a lower receiver of a firearm.

BRIEF SUMMARY OF THE DISCLOSURE

Disclosed herein is a buffer tube locking assembly for attachment of a buffer tube to a firearm. The buffer tube locking assembly in one example comprising: a buffer tube locking plate having a pass-through surface defining a cylinder larger in diameter than a threaded portion of the buffer tube; the buffer tube locking plate having a protrusion vertically offset and non-overlapping with the pass-through surface of the buffer tube locking plate; a castle nut having a flat surface engaging a surface of the buffer locking plate; the castle nut having a female threaded surface axially aligned with the cylindrical outer surface and configured to thread onto a male threaded surface of the buffer tube; the castle nut having a radially outward toothed surface axially aligned with the cylindrical outer surface; the toothed surface comprising radially extending projections separated by grooves; and a flexible indexing pin attached to the buffer tube locking plate and engaging the toothed surface of the castle nut so as to restrict rotation of the castle nut relative to the buffer tube locking plate.

The buffer tube locking assembly as recited above wherein the toothed surface extends radially outward on the castle nut.

The buffer tube locking assembly as recited above wherein the castle nut comprises a non-cylindrical tool engagement surface configured to increase contact between the castle nut and a leverage increasing tool.

The buffer tube locking assembly as recited above wherein a pass-through surface of the buffer tube locking plate comprises a protrusion extending radially inward, the protrusion configured to engage a groove in the buffer tube hindering rotation of the buffer tube relative to the buffer tube locking plate.

The buffer tube locking assembly as recited above wherein the flexible indexing pin has a first end fixed to the buffer tube locking plate.

The buffer tube locking assembly as recited above may be arranged wherein the first end of the indexing pin is press fit, adhered, welded, or otherwise affixed to the buffer locking plate and a second end of the indexing pin protrudes from the buffer tube locking plate in a cantilevered arrangement.

BRIEF DESCRIPTION OF THE SEVERAL VIEWS OF THE DRAWINGS

FIG. 1 is a side view of a buffer tube attached to a lower receiver of a firearm with the disclosed buffer tube locking plate assembly installed there between.

DETAILED DESCRIPTION OF THE DISCLOSURE

Disclosed herein is a buffer to locking plate assembly facilitating secure attachment of a buffer to the receiver portion of a firearm. Although similar components have been utilized to mount buffer tubes to the receiver portions of the firearm, secure attachment without vibration transmission, relative rotation, and correct longitudinal positioning was found to be insufficient.

Figure 1:
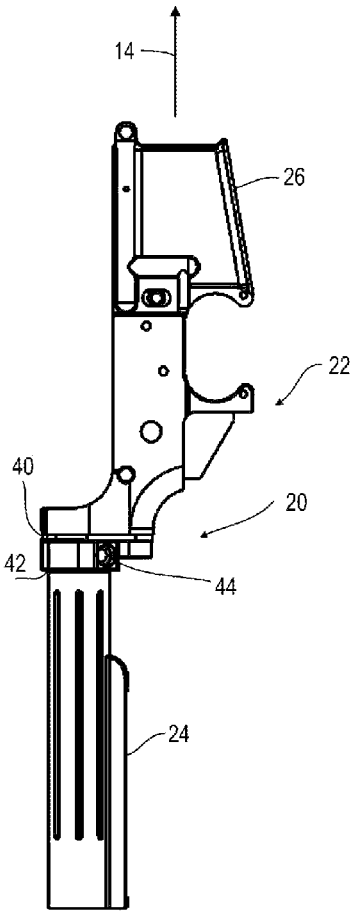
Figure 2:
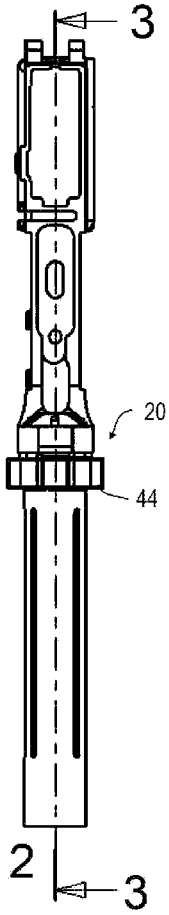
FIG. 2 is a bottom view of the components shown in FIG. 1.
Figure 3:
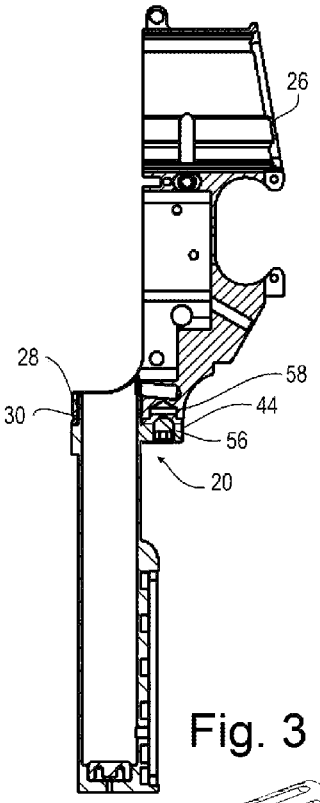
FIG. 3 is a cutaway view taken along line 3-3 of FIG. 2.
Figure 4:
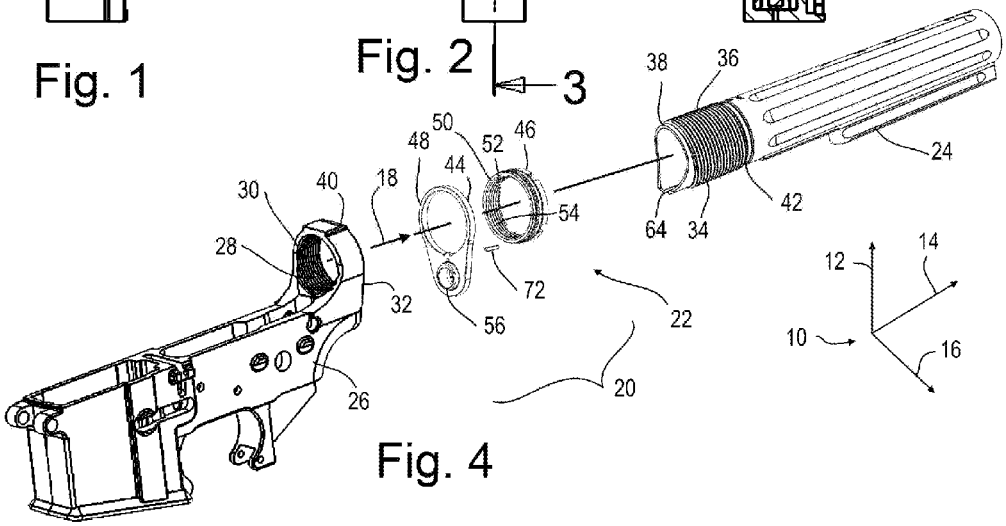
FIG. 4 is an exploded view of the components shown in FIG. 1.

Before continuing, an axes system 10 is shown in FIG. 4 relative to the position of the components. It is to be understood that this axes system is intended to be used only for description of the components and is not intended to limit the apparatus to one orientation. This axes system 10 comprises a vertical axis 12 pointing in an upwards direction with the opposing direction being downwards. The axes system 10 further comprising a longitudinal axis 14 pointing in a rearward direction relative to the normal firing direction of the firearm with the opposing direction being forward. The axes system 10 further comprising a transverse axis 16 pointing in a left direction with the opposing direction being right. A rotational axis 18 is also shown aligned with the major axis of the buffer tube 24, castle nut 46, and female threaded surface 28 of the lower receiver 26 when the firearm is assembled.

Disclosed herein is a buffer tube locking plate assembly 20 which interoperates with a firearm assembly 22, the components of which include a buffer tube 24 and a lower receiver 26. The lower receiver 26 having a female threaded surface 28 with spiral threads 30 provided thereon at the rearward end 32 thereof. The buffer tube 24 in this example having a male threaded region 34 having threads 36 on a cylindrical forward end 38 of the lower receiver 26.

Looking to FIGS. 1-4 is shown one example of the buffer tube locking plate assembly 20 interposed between a longitudinally rearward surface 40 of the lower receiver 26 and the longitudinally forward surface 42 of the buffer tube 24. The buffer tube locking plate assembly 20 of this example comprising a buffer locking plate 44 and a castle nut 46. Each of these will be described in detail below.

In this example, the buffer locking plate 44 has flat (planar) longitudinally rearward surface 48 which interoperates with a substantially flat longitudinally forward surface 50 of the castle nut 46 in a sliding engagement about a rotational axis 18 generally aligned with the axis of the buffer tube 24, and castle nut 46.

It can be seen in this example that the male threaded region 34 of the buffer tube 24 is configured such that the threads 36 of the buffer tube 24 engage female threads 52 on an inner cylindrical surface 54 of the castle nut 46. Thus, the castle nut 46 may be threaded onto the threaded forward end 38 of the buffer tube 24. As the threads 36 of the buffer tube 24 are threaded into the female threaded surface 28 of the lower receiver 26, upon achieving the correct longitudinal 14 and rotational 18 position of the buffer tube 24 relative to the lower receiver 26, the castle nut 46 is tensioned against the rearward and 32 of the lower receiver 26 as a stop nut, thus prohibiting rotation and longitudinal movement of the buffer tube 24 relative to the lower receiver 26.

One disadvantage of such previously known simple stop-nut type arrangements is that due to the movements of the firearm assembly 22 encountered during shooting (firing of the firearm), a simple stop nut may become dislodged and disadvantageously rotate. Thus is disclosed herein an additional mechanism which further prohibits accidental or unwanted rotation of the castle nut 46 relative to the buffer tube 24.

In the example shown, the buffer tube locking plate 44 comprises a forward protrusion 56 on an extension (protrusion) vertically offset below and non-overlapping the pass-through (inner) surface 60 of the buffer locking plate 44. The forward protrusion 56 engages a recess 58 in the rearward end of the firearm lower receiver 26 (see the cross-sectional view of FIG. 3). The buffer locking plate 44 of this example has a substantially cylindrical inner surface 60 with a radial protrusion 62 which engages a groove or detent 64 in the buffer tube 24 so as to prohibit rotation of the buffer tube locking plate 44 relative to the buffer tube 24. Thus, when the buffer tube 24 is in the desired rotational and longitudinal position relative to the lower receiver 26, the buffer locking plate 44 may be longitudinally repositioned (slid) toward the lower receiver 26 such that the longitudinally forward protrusion 56 engages the recess 58. This positional arrangement prohibits rotation of the buffer locking plate 44 relative to the lower receiver 26 and also prohibits rotation of the buffer tube 24 relative to the buffer locking plate 44. In combination, this structural arrangement prohibits rotation and longitudinal movement of the buffer tube 24 relative to the lower receiver 26. When the castle nut 46 is rotated such that the forward cylindrical surface 50 of the castle nut 46 engages the rearward surface 66 of the buffer locking plate 44, providing tension thereupon, longitudinal movement of the buffer locking plate 44 is prohibited.

To further tension the castle nut 46 against the buffer locking plate 44, a hand tool such as a wrench having teeth which engage surfaces defining grooves 68(*a-d*) around the castle nut 46 to provide leverage an additional rotational torque to the castle nut 46 which is translated into compressive force by the threads 52. The grooves 68 being one example of a non-cylindrical tool engagement surface configured to increase contact between the castle nut and a leverage increasing tool. This structural arrangement maintains the buffer locking plate 44 in position and prohibits rotation of the buffer tube 24 relative to the lower receiver 26.

As previously disclosed, due to the sudden jarring and movement experienced by the firearm assembly 22 during shooting, it is potentially possible for the castle nut 46 to counter rotate and loosen thus allowing repositioning of the buffer locking plate 44 and potentially the buffer tube 24 relative to the lower receiver 26. Thus, disclosed herein is a counter rotation mechanism 70 which substantially hinders rotation of the castle nut 46 relative to the buffer locking plate 44.

Figure 5:
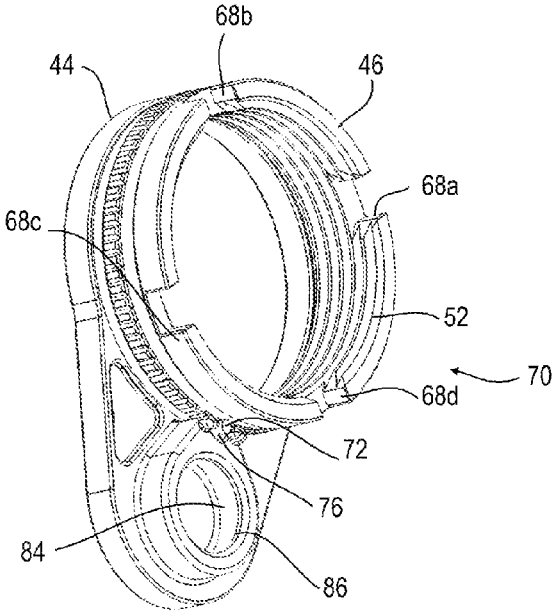
FIG. 5 is an enlarged front isometric view of one example of the disclosed buffer tube locking plate assembly.
Figure 6:
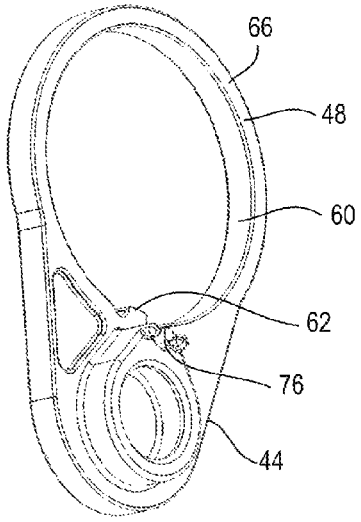
FIG. 6 is an isometric view of one example of a buffer locking plate component of the assembly shown in FIG. 5.
Figure 7:
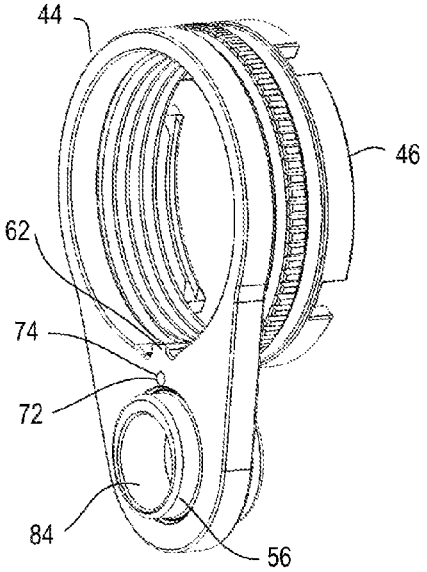
FIG. 7 is a rear isometric view of the components shown in FIG. 5.
Figure 8:
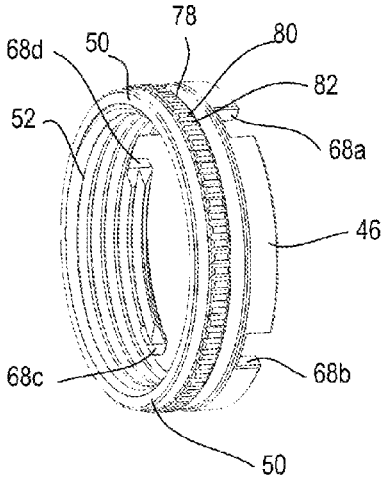
FIG. 8 is a rear isometric view of one example of a castle nut component of the assembly shown in FIG. 5.

Looking to FIG. 5 can be seen a indexing pin 72 having a first end 74 which is press fit, adhered, welded, or otherwise affixed to the buffer locking plate 44 and a second end 76 which protrudes therefrom in a cantilevered arrangement.

It can also be seen that in this example, the castle nut 46 comprises a structure comprising a toothed surface 78 having a rotational series of protrusions 80 separated by grooves 82. When the castle nut 46 and the locking plate 44 are in contact with the outer surface of the forward end 38 of the buffer tube 24, forced rotation of the castle nut 46 causes the index pin 72 to sequentially engage the grooves 82 between protrusions 80 in the toothed surface 78 and given adequate rigidity of the indexing pin 72, it will take substantial and continuous rotational torque to rotate the castle nut 46 past the protrusions 80 on either side of the groove 82 engaging the indexing pin 72 at any point in time. As the shock force encountered by the firearm assembly 22 during firing is very short in duration this shock force will not generally provide enough continuous rotational force to overcome the resistance force of the indexing pin 72 in any groove.

The buffer tube locking plate 44 of this example also has a surface 84 defining an open cylinder forming a sling swivel mount 86. The sling swivel mount 86 interoperating with a rifle sling or other component known in the art, often to carry the firearm 22. One example of such a sling is disclosed in U.S. Pat. No. 2,480,662 incorporated herein by reference.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A buffer tube locking assembly for attachment of a buffer tube to a firearm, the buffer tube locking assembly comprising:

a buffer tube locking plate having a rearward surface and a pass-through surface defining a cylinder larger in diameter than a threaded portion of the buffer tube;

the buffer tube locking plate having a protrusion vertically offset below and non-overlapping with the pass-through surface of the buffer tube locking plate;

a castle nut having a forward surface engaging the rearward surface of the buffer tube locking plate;

the castle nut having a female threaded surface configured to thread onto a male threaded surface of the buffer tube;

the castle nut having a radially outward toothed surface;

the toothed surface comprising radially extending projections separated by grooves; and an indexing pin having a first end attached to the buffer tube locking plate and a second end engaging the toothed surface of the castle nut so as to restrict rotation of the castle nut relative to the buffer tube locking plate.

2. The buffer tube locking assembly as recited in claim 1 wherein the toothed surface extends radially outward on the castle nut.

3. The buffer tube locking assembly as recited in claim 1 wherein the castle nut comprises a non-cylindrical tool engagement surface configured to increase contact between the castle nut and a leverage-increasing tool.

4. The buffer tube locking assembly as recited in claim 1 wherein the pass-through surface of the buffer locking plate comprises a protrusion extending radially inward, the protrusion engaging a groove in the buffer tube, thus hindering rotation of the buffer tube relative to the buffer locking plate.

5. The buffer tube locking assembly as recited in claim 1 wherein the first end of the indexing pin is press fit, adhered, welded, or otherwise affixed to the buffer locking plate and the second end of the indexing pin protrudes from the buffer tube locking plate in a cantilevered arrangement.

* * * * *